US011933178B2

(12) United States Patent
Wu et al.

(10) Patent No.: US 11,933,178 B2
(45) Date of Patent: Mar. 19, 2024

(54) METHOD FOR FILLING DEFORMABLE KARST CAVE

(71) Applicant: Shandong University, Jinan (CN)

(72) Inventors: Ke Wu, Jinan (CN); Yajun Liu, Jinan (CN); Zhongyu Dou, Jinan (CN); Zhenhua Liu, Jinan (CN); Dapeng Liu, Jinan (CN); Wenbin Xu, Jinan (CN)

(73) Assignee: Shandong University, Jinan (CN)

( * ) Notice: Subject to any disclaimer, the term of this patent is extended or adjusted under 35 U.S.C. 154(b) by 0 days.

(21) Appl. No.: 18/456,347

(22) Filed: Aug. 25, 2023

(65) Prior Publication Data

US 2023/0407746 A1 Dec. 21, 2023

Related U.S. Application Data

(63) Continuation of application No. PCT/CN2021/098869, filed on Jun. 8, 2021.

(30) Foreign Application Priority Data

May 31, 2021 (CN) ..... 202110602950.1

(51) Int. Cl.
*E21F 15/00* (2006.01)
*E02D 3/12* (2006.01)
*E21F 15/06* (2006.01)

(52) U.S. Cl.
CPC ..... *E21F 15/005* (2013.01); *E02D 3/12* (2013.01); *E21F 15/06* (2013.01)

(58) Field of Classification Search
CPC ..... E21F 15/005; E02D 3/12
See application file for complete search history.

(56) References Cited

U.S. PATENT DOCUMENTS 6,322,292 B1 * 11/2001 Zenari ..... E02D 3/12 405/266
2008/0205995 A1 * 8/2008 Canteri ..... E21F 15/005 405/263
2017/0058478 A1 * 3/2017 Kirchendorfer ..... E02D 5/46

FOREIGN PATENT DOCUMENTS

CN 106498965 A 3/2017
CN 109384879 A 2/2019
(Continued)

OTHER PUBLICATIONS

Internation Search Report of PCT/CN2021/098869, dated Feb. 28, 2022.

*Primary Examiner* — Janine M Kreck

(57) ABSTRACT

The present invention relates to method for filling deformable karst cave, and the steps are: penetrating a grouting pipe into an elastic silicone tube, penetrating the grouting pipe and the elastic silicone tube into a deformable bracket, and lowering into a karst cave; sealing the elastic silicone tube, injecting silicate resin materials into the grouting pipe, and injecting steel fiber reinforced grout to implement a "block stone-like" structure; sealing the elastic silicone tube, separating the "block stone-like" structure from the elastic silicone tube to complete a "block stone-like" structure; lowering the elastic silicone tube and the deformable bracket, sealing the elastic silicone tube, lowering the elastic silicone tube and the deformable bracket tore construct the "block stone-like" structure, and completing the filling. The present invention may effectively stabilize the karst cave, ensure safe tunnel construction and stable surrounding rocks, and improve engineering construction speed.

5 Claims, 5 Drawing Sheets

(56) References Cited

FOREIGN PATENT DOCUMENTS

| | | | |
|---|---|---|---|
| CN | 109750662 | A | 5/2019 |
| CN | 109931077 | A | 6/2019 |
| CN | 110080779 | A | 8/2019 |
| CN | 110984120 | A | 4/2020 |
| CN | 211621548 | U | 10/2020 |
| CN | 112253227 | A | 1/2021 |
| CN | 113217092 | A | 8/2021 |
| DE | 3837655 | A1 | 5/1990 |

* cited by examiner

METHOD FOR FILLING DEFORMABLE KARST CAVE

CROSS REFERENCE TO RELATED APPLICATIONS

This application is a continuation of International Patent Application No. PCT/CN2021/098869 with a filing date of Jun. 8, 2021, designating the United States, and further claims priority to Chinese Patent Application No. 202110602950.1 with a filing date of May 31, 2021. The content of the aforementioned applications, including any intervening amendments thereto, are incorporated herein by reference.

TECHNICAL FIELD

The present invention relates to a method for filling deformable karst cave and is applicable to filling and reinforcement of the karst cave during excavation and construction of a tunnel at a karst area. The present invention may efficiently stabilize the karst cave, ensure safety construction of the tunnel and stabilization of surrounding rocks, reduce influences of the karst cave on tunnel construction and later operations, may reduce engineering construction costs and improve an engineering construction speed, and belongs to the field of underground engineering.

BACKGROUND

With the development of transportation power construction of China, a scale of tunnel construction involved in highway, railway and urban rail transit engineering is expanding, and the tunnel engineering construction inevitably passes through high-risk karst areas; karst caves have great hidden dangers to the safety of the tunnel engineering construction, and need to be filled and reinforced in an early stage; and if the karst caves cannot be effectively filled and reinforced, it is very easy to cause collapse of surrounding rocks or a bottom bearing stratum during excavation and construction of the tunnel, resulting in the burial of excavation machines or personnel, and endangering life safety of builders. However, a traditional karst cave filling method during the tunnel construction at the karst area is to use a grouting process to reinforce the karst cave by filling grout or mortar into the karst cave. This method has a long grouting time and large consumption of materials, and it is not easy to form a filling and reinforcement region in case of encountering a groundwater rich area; and if block stones can be put into the karst cave and then seriflux is injected into the karst cave, a complementary reinforcement effect between different sizes of block stones and the seriflux may be better implemented, and a filling and reinforcement effect of the karst cave may be improved more effectively. However, the size of the diameter of a grouting hole limits a passing property of the block stones, and only small size of block stones can be filled into the karst cave through the grouting hole, but a filling effect is not ideal.

Therefore, based on the limit of the diameter of the grouting hole and a deformable body theory, there is provided a technology for filling a deformable "block stone like" karst cave, the technology including a deformable bracket, an elastic silicone tube, a lock apparatus, and a filling material. The deformable bracket may pass through a limited space of the grouting hole and may be propped up to form a bracket with the filling of the filling material in the karst cave; the elastic silicone tube is a long film tube made of an elastic silicone material, and the long tube may be propped up without breaking with the filling of the filling material; the lock apparatus may cut the elastic silicone tube and implement sealing of the opening of the tube; and the filling material is that: silicate resin materials are filled into the elastic silicone tube first to implement fast expansion and reinforcement, and then a proper amount of grout is injected to implement the "block stone like" structure. The apparatus may efficiently stabilize the karst cave, ensure safety construction of the tunnel and stabilization of surrounding rocks, reduce influences of the karst cave on tunnel construction and later operations, and may reduce engineering construction costs and improve an engineering construction speed.

SUMMARY

For the above questions, the present invention provides a method for filling deformable karst cave, and the present invention may efficiently stabilize the karst cave.

The technical solutions of the present invention are as follows:

a method for filling deformable karst cave, including the following steps:

(1) penetrating a grouting pipe into an elastic silicone tube, and then penetrating the grouting tube and the elastic silicone tube into a deformable bracket as a whole;

(2) lowering the whole pipeline completed above into the karst cave along a borehole conduit;

(3) a console controlling a circumferential lock apparatus by means of the pipeline, to implement that a circumferential lock close insert closely seals the elastic silicone tube to enable the bottom of the elastic silicone tube to be sealed without leakage of grout, and then lowering the elastic silicone tube and the deformable bracket by 50 cm along the grouting pipe;

(4) injecting the amount of silicate resin materials into the grouting pipe under the control of a grouting device to fill the elastic silicone tube at the bottom of the borehole conduit to implement fast expansion thereof, and to ensure deformation and expansion of the deformable bracket with the expansion of the elastic silicone tube;

(5) injecting steel fiber reinforced grout that is stirred evenly into the grouting pipe under the control of the grouting device to fill the elastic silicone tube at the bottom of the borehole conduit to implement a "block stone like" structure;

(6) the console controlling the circumferential lock apparatus by means of the pipeline, to implement that the circumferential lock close insert closely seals the elastic silicone tube, and the grouting device stopping grouting at the same time;

(7) the console controlling a circumferential scissor apparatus located above the circumferential lock apparatus by means of the pipeline to implement that the circumferential scissor cuts the elastic silicone tube and the deformable bracket to complete separation of the formed "block stone like" structure from the elastic silicone tube, thereby completing a first "block stone like" structure;

(8) lowering the elastic silicone tube and the deformable bracket by 10 cm along the grouting pipe;

(9) the console controlling the circumferential lock apparatus by means of the pipeline, to implement that the circumferential lock close insert closely seals the elastic silicone tube;

(10) lowering the elastic silicone tube and the deformable bracket by 50 cm along the grouting pipe;

(11) repeating steps (4) to (7) to successively complete the "block stone like" structure to complete filling the deformable karst cave finally.

Further, the deformable bracket is circular with a diameter of 40 cm after the deformable bracket is expanded, and the material thereof is steel wire.

Further, the elastic silicone tube has an inner diameter of 25 cm and a thickness of 2 cm.

Further, the filling material includes silicate resin, grout, and a small amount of steel fibers; and the filling steps of the filling material are:

(1) dividing the silicate resin into two groups: A and B, where in group A, a viscosity is 300 cp, and a density is 1500 g/cm3, and in group B, a viscosity is 135 cp, and a density is 1200 g/cm3, and injecting groups A and B into the elastic silicone tube after being mixed at a volume ratio of 1:1; and (2) injecting the steel fiber and the grout into the elastic silicone tube to complete the filling after being stirred evenly at a mass ratio of 1:10.

The elastic silicone tube is expanded after the silicate resin is filled, and the deformable bracket is expanded at the same time, and then grout with the steel fiber is injected to form the "block stone like" structure.

Compared with the prior art, the present invention has the following advantages:

the present invention forms the "block stone like" structure after the filling, which may effectively stabilize the karst cave, ensure safety construction of the tunnel and stabilization of surrounding rocks and reduce influences of the karst cave on tunnel construction and later operations, may reduce engineering construction costs, and may improve an engineering construction speed.

REFERENCE NUMERALS ARE AS FOLLOWS

1. block stone like structure, 2. karst cave, 3. borehole conduit, 4. grouting device, 5. console, 6. deformable bracket, 7. pipeline, 8. grouting pipe, 9. elastic silicone tube, 10. circumferential scissor apparatus, 11. circumferential lock apparatus, 12. circumferential scissor, and 13. circumferential lock close insert.

DETAILED DESCRIPTION OF THE EMBODIMENTS

The present invention is further described below with reference to specific embodiments, and the advantages and features of the present invention will be more clear with the description. However, the embodiments are merely exemplary and do not constitute any limitations to the scope of the present invention. Those skilled in the art should understand that modifications and replacements may be made to details and forms of the technical solutions of the present invention without departing from the spirit and scope of the present invention, and these modifications and replacements all fall within the protection scope of the present invention.

Embodiment 1

A Method for Filling Deformable Karst Cave

Figure 1:
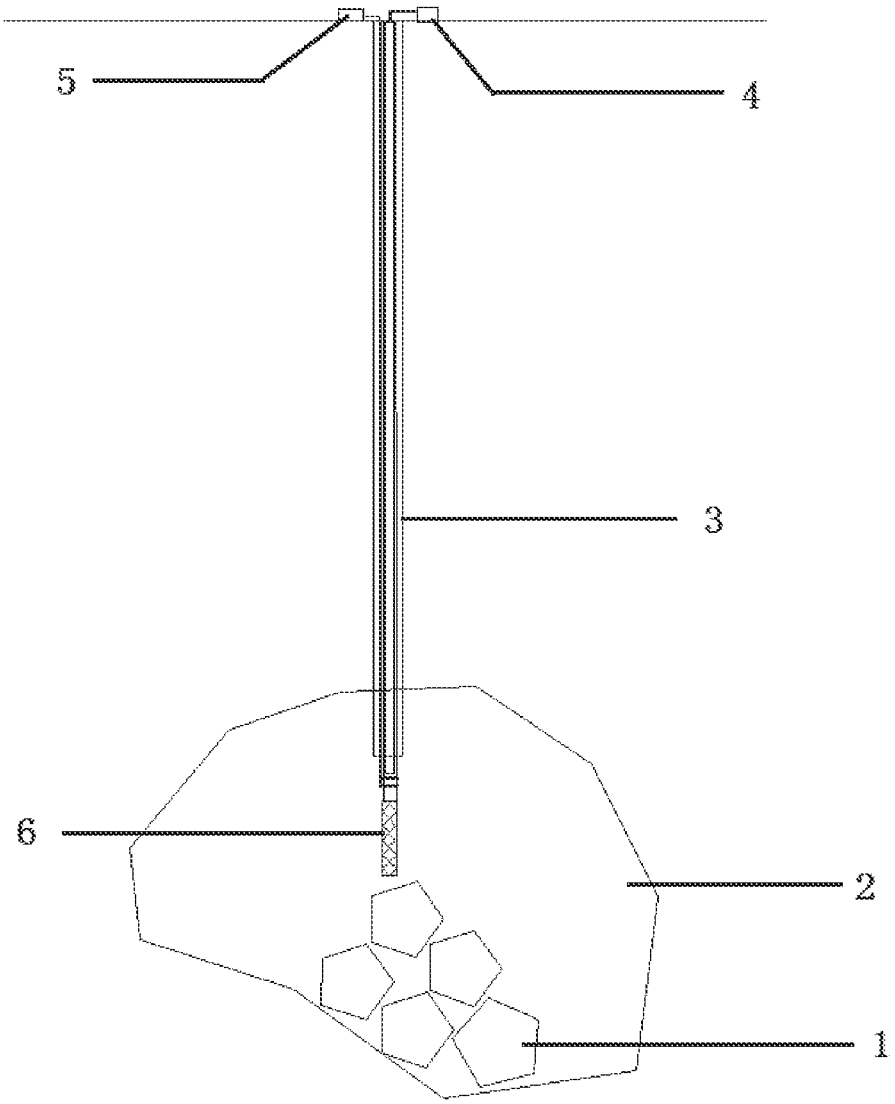
FIG. 1 is a schematic working diagram of a technology for filling a deformable "block stone like" karst cave.
Figure 2:
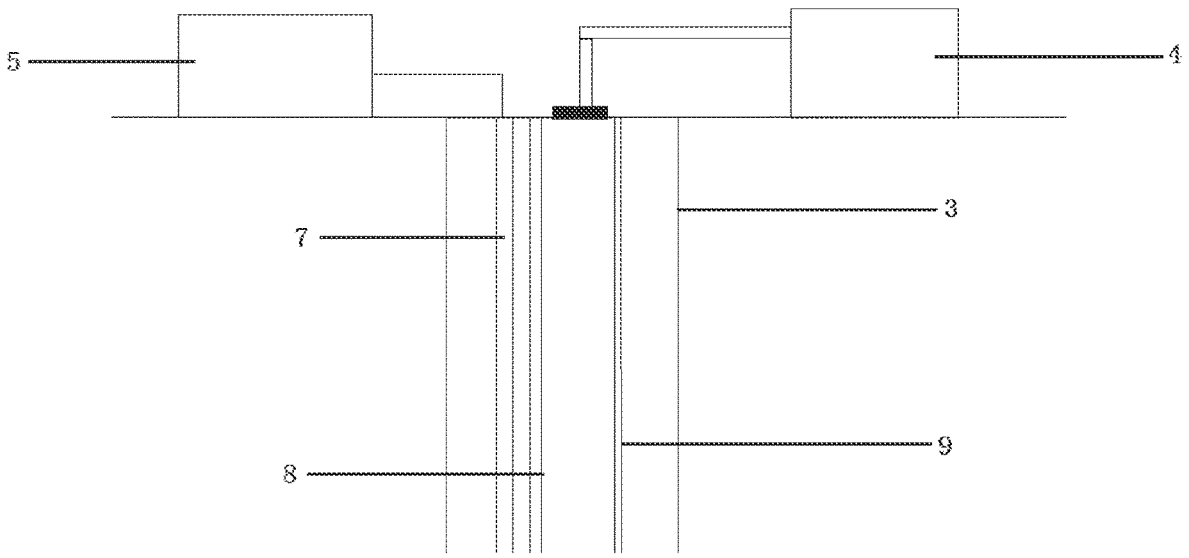
FIG. 2 is a schematic diagram of an inner longitudinal section of a conduit.
Figure 3:
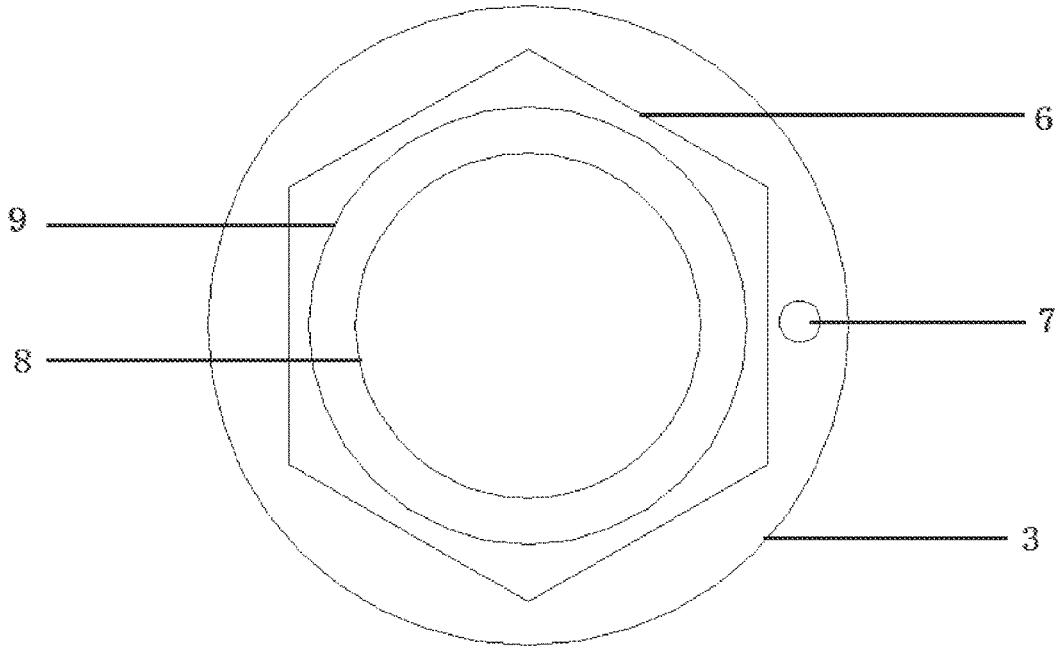
FIG. 3 is a schematic diagram of an inner cross section of a conduit.
Figure 4:
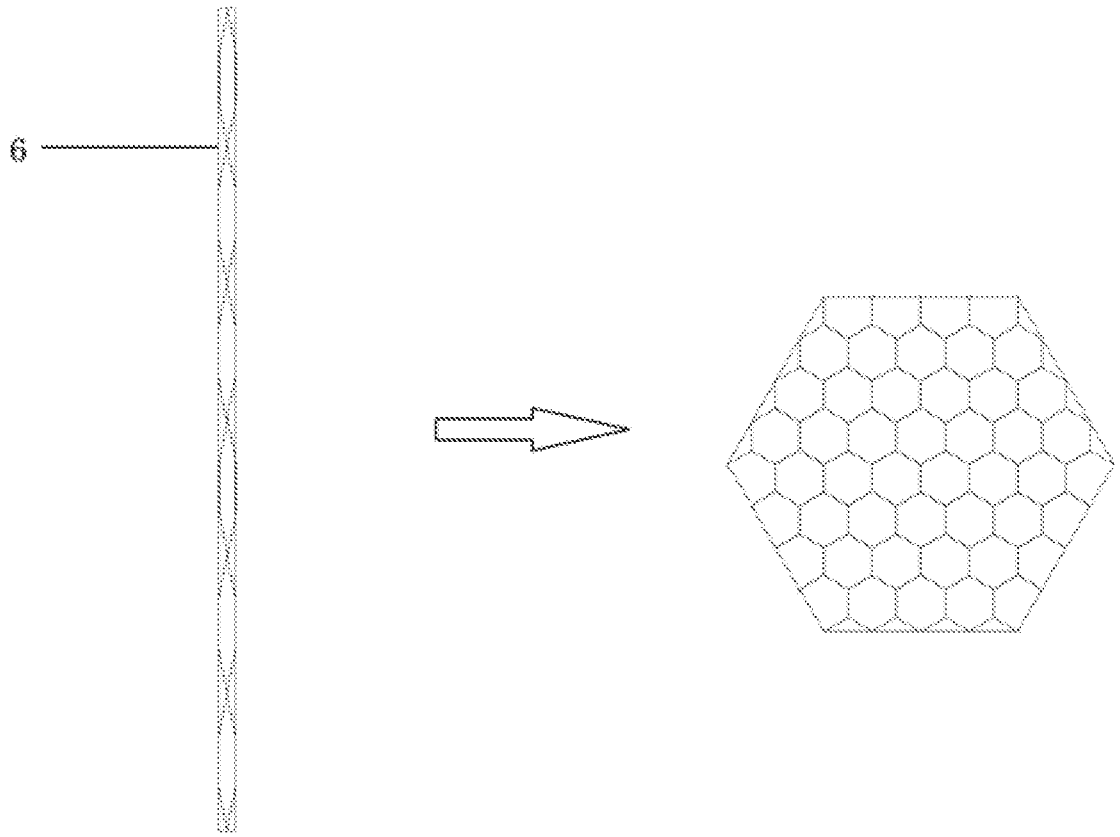
FIG. 4 is a schematic diagram of expansion and contraction of a deformable bracket.
Figure 5:
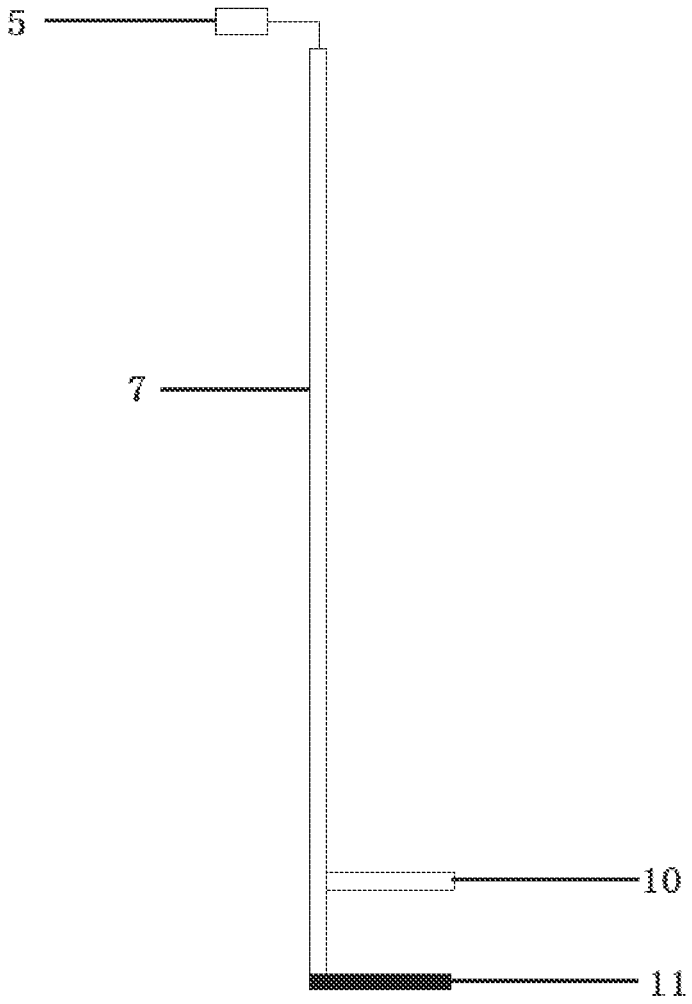
FIG. 5 is a schematic working diagram of a lock apparatus.
Figure 6:
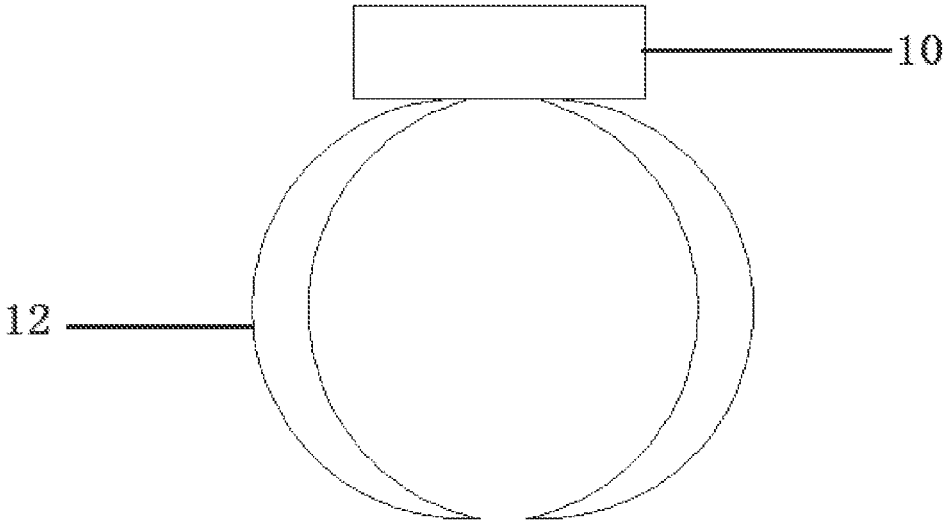
FIG. 6 is a schematic diagram of a circumferential scissor apparatus of a lock apparatus.
Figure 7:
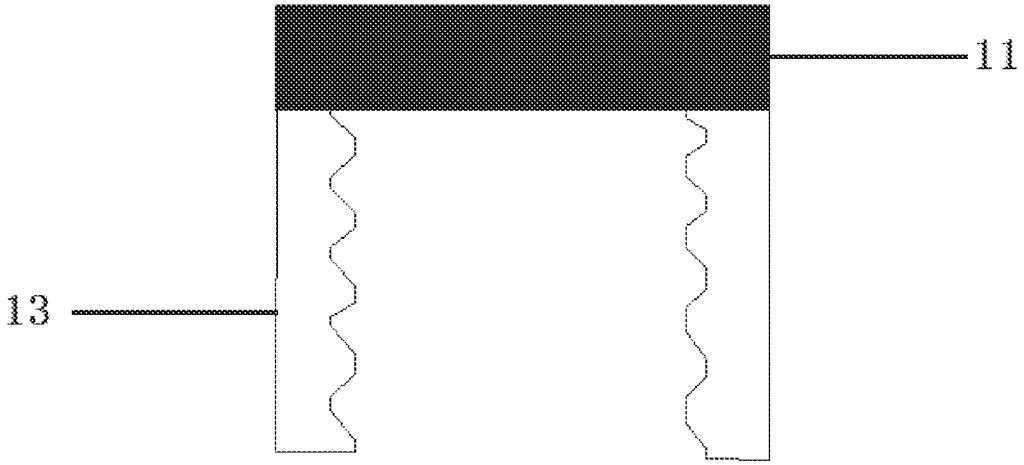
FIG. 7 is a schematic diagram of a circumferential lock apparatus of a lock apparatus.

As shown in FIGS. 1 to 7, the steps are as follows:

(1) penetrating a grouting pipe 8 into an elastic silicone tube 9, and then penetrating the grouting tube and the elastic silicone tube into a deformable bracket 6 as a whole;

(2) lowering the whole pipeline completed above into the karst cave 2 along a borehole conduit 3;

(3) a console 5 controlling a circumferential lock apparatus 11 by means of a pipeline 7, to implement that a circumferential lock close insert 13 closely seals the elastic silicone tube 9 to enable the bottom of the elastic silicone tube 9 to be sealed without leakage of grout, and then lowering the elastic silicone tube 9 and the deformable bracket 6 by 50 cm along the grouting pipe 8;

(4) injecting the amount of silicate resin materials into the grouting pipe 8 under the control of a grouting device 4 to fill the elastic silicone tube 9 at the bottom of the borehole conduit 3 to implement fast expansion thereof, and to ensure deformation and expansion of the deformable bracket 6 with the expansion of the elastic silicone tube 9;

(5) injecting steel fiber reinforced grout that is stirred evenly into the grouting pipe 8 under the control of a grouting device 4 to fill the elastic silicone tube 9 at the bottom of the borehole conduit 3 to implement a "block stone like" structure;

(6) the console 5 controlling the circumferential lock apparatus 11 by means of the pipeline 7, to implement that the circumferential lock close insert 13 closely seals the elastic silicone tube 9, and the grouting device 4 stopping grouting at the same time;

(7) the console 5 controlling a circumferential scissor apparatus 10 located above the circumferential lock apparatus 11 by means of the pipeline 7 to implement that the circumferential scissor 12 cuts the elastic silicone tube 9 and the deformable bracket 6 to complete separation of the formed "block stone like" structure 1 from the elastic silicone tube 9, thereby completing a first "block stone like" structure 1;

(8) lowering the elastic silicone tube 9 and the deformable bracket 6 by 10 cm along the grouting pipe 8;

(9) the console 5 controlling the circumferential lock apparatus 11 by means of the pipeline 7, to implement that the circumferential lock close insert 13 closely seals the elastic silicone tube 9;

(10) lowering the elastic silicone tube 9 and the deformable bracket 6 by 50 cm along the grouting pipe 8;

(11) repeating steps (4) to (7) to successively complete the "block stone like" structure to complete filling the deformable karst cave finally.

Embodiment 2 based on Embodiment 1, the deformable bracket 6 is circular with a diameter of 40 cm after the deformable bracket is expanded, and the material thereof is steel wire; the elastic silicone tube 9 has an inner diameter of 25 cm and a thickness of 2 cm; and filling steps of the filling material are:

(1) dividing the silicate resin into two groups: A and B, where in group A, a viscosity is 300 cp, and a density is 1500 g/cm3, and in group B, a viscosity is 135 cp, and a density is 1200 g/cm3, and injecting groups A and B into the elastic silicone tube after being mixed at a volume ratio of 1:1; and (2) injecting the steel fiber and the grout into the elastic silicone tube to complete the filling after being stirred evenly at a mass ratio of 1:10.

What is claimed is:

1. A method for filling deformable karst cave, characterized in that steps of the filling method are as follows:

(1) penetrating a grouting pipe into an elastic silicone tube, and then penetrating the grouting tube and the elastic silicone tube into a deformable bracket as a whole;

(2) lowering a whole pipeline completed above into the karst cave along a borehole conduit;

(3) a console controlling a circumferential lock apparatus by means of the pipeline, to implement that a circumferential lock close insert closely seals the elastic silicone tube to enable the bottom of the elastic silicone tube to be sealed without leakage of grout, and then lowering the elastic silicone tube and the deformable bracket by 50 cm along the grouting pipe;

(4) injecting an amount of silicate resin materials into the grouting pipe under the control of a grouting device to fill the elastic silicone tube at the bottom of the borehole conduit to implement fast expansion thereof, and to ensure deformation and expansion of the deformable bracket with the expansion of the elastic silicone tube;

(5) injecting steel fiber reinforced grout that is stirred evenly into the grouting pipe under the control of the grouting device to fill the elastic silicone tube at the bottom of the borehole conduit to implement a "block stone like" structure;

(6) the console controlling the circumferential lock apparatus by means of the pipeline, to implement that the circumferential lock close insert closely seals the elastic silicone tube, and the grouting device stopping grouting at the same time;

(7) the console controlling a circumferential scissor apparatus located above the circumferential lock apparatus by means of the pipeline to implement that the circumferential scissor cuts the elastic silicone tube and the deformable bracket to complete separation of the formed "block stone like" structure from the elastic silicone tube, thereby completing a first "block stone like" structure;

(8) lowering the elastic silicone tube and the deformable bracket by 10 cm along the grouting pipe;

(9) the console controlling the circumferential lock apparatus by means of the pipeline, to implement that the circumferential lock close insert closely seals the elastic silicone tube;

(10) lowering the elastic silicone tube and the deformable bracket by 50 cm along the grouting pipe; and

(11) repeating steps (4) to (7) to successively complete the "block stone like" structure to complete filling the deformable karst cave finally.

2. The method for filling deformable karst cave according to claim 1, wherein the deformable bracket is circular with a diameter of 40 cm after the deformable bracket is expanded, and the material thereof is steel wire.

3. The method for filling deformable karst cave according to claim 1, wherein the elastic silicone tube has an inner diameter of 25 cm and a thickness of 2 cm.

4. The method for filling deformable karst cave according to claim 1, wherein a filling material comprises silicate resin, grout, and steel fiber.

5. The method for filling deformable karst cave according to claim 4, wherein filling steps of the filling material are as follows:

(1) dividing the silicate resin into two groups: A and B, wherein in group A, a viscosity is 300 cp, and a density is 1500 g/cm$^3$, and in group B, a viscosity is 135 cp, and a density is 1200 g/cm$^3$, and injecting groups A and B into the elastic silicone tube after being mixed at a volume ratio of 1:1; and (2) mixing the steel fiber and the grout in a 1:10 mass ratio to obtain a mixture, then uniformly stirring and injecting the mixture into the elastic silicone tube to complete the filling.

* * * * *